US007797938B2

(12) United States Patent
Ruiz

(10) Patent No.: US 7,797,938 B2
(45) Date of Patent: Sep. 21, 2010

(54) ENERGY RECOVERY SYSTEM

(75) Inventor: Victoriano Ruiz, Roscommon, MI (US)

(73) Assignee: Caterpillar Inc, Peoria, IL (US)

( * ) Notice: Subject to any disclaimer, the term of this patent is extended or adjusted under 35 U.S.C. 154(b) by 97 days.

(21) Appl. No.: 11/882,246

(22) Filed: Jul. 31, 2007

(65) Prior Publication Data

US 2009/0031724 A1 Feb. 5, 2009

(51) Int. Cl.
*F02G 3/00* (2006.01)
*F01K 13/02* (2006.01)
*F01N 5/02* (2006.01)

(52) U.S. Cl. ..... 60/614; 60/615; 60/618; 60/660; 60/661; 60/298; 60/320

(58) Field of Classification Search ..... 60/618, 60/614, 615, 320, 298, 660, 661
See application file for complete search history.

(56) References Cited

U.S. PATENT DOCUMENTS 3,500,636 A * 3/1970 Craig ..... 60/773
3,894,605 A * 7/1975 Salvadorini ..... 180/65.4
4,257,223 A * 3/1981 Enga ..... 60/774
4,594,850 A * 6/1986 Joy ..... 60/791
4,912,928 A * 4/1990 Kaneko et al. ..... 60/320
5,176,000 A 1/1993 Dauksis
5,899,063 A * 5/1999 Leistritz ..... 60/298
6,141,952 A * 11/2000 Bachmann et al. ..... 60/772
6,250,258 B1 * 6/2001 Liebig ..... 122/406.5
6,301,890 B1 * 10/2001 Zeretzke ..... 60/597
6,393,840 B1 5/2002 Hay
6,478,644 B1 11/2002 Ozawa et al.
6,647,727 B2 * 11/2003 Klatt et al. ..... 60/662
6,725,662 B2 * 4/2004 Baba et al. ..... 60/620
6,880,344 B2 * 4/2005 Radcliff et al. ..... 60/618
6,910,333 B2 * 6/2005 Minemi et al. ..... 60/618
6,986,247 B1 * 1/2006 Parise ..... 60/284
7,055,315 B2 * 6/2006 Shinohara et al. ..... 60/320
7,178,332 B2 * 2/2007 Sasaki ..... 60/320
7,392,655 B2 * 7/2008 Inaba et al. ..... 60/614
2002/0005040 A1 * 1/2002 Moody ..... 60/320
2002/0007636 A1 1/2002 Hay
2003/0005696 A1 1/2003 Wilson
2003/0093995 A1 * 5/2003 Tadayon et al. ..... 60/651
2004/0055283 A1 * 3/2004 Iihoshi et al. ..... 60/320
2005/0262842 A1 12/2005 Claasen et al.

(Continued)

FOREIGN PATENT DOCUMENTS

DE 2917371 A * 11/1980

(Continued)

*Primary Examiner*—Thomas E Denion
*Assistant Examiner*—Mary A Davis
(74) *Attorney, Agent, or Firm*—Finnegan, Henderson, Farabow, Garrett & Dunner LLC

(57) ABSTRACT

An energy recovery system is provided having a fluid configured to absorb and convey thermal energy. The system also has an exhaust treatment device cooling system configured to transmit thermal energy from an exhaust treatment device to the fluid. In addition, the system has a turbine that is driven by the fluid configured to convert at least a portion of the thermal energy to mechanical energy. The system further has a generator that is powered by the turbine configured to convert at least a portion of the mechanical energy to electrical energy.

17 Claims, 3 Drawing Sheets

U.S. PATENT DOCUMENTS

| | | | | |
|---|---|---|---|---|
| 2006/0037320 | A1 | 2/2006 | Hildebrandt | |
| 2007/0056284 | A1 | 3/2007 | Kalina | |
| 2007/0101716 | A1 | 5/2007 | Tafas | |
| 2008/0041046 | A1 * | 2/2008 | Bering | 60/320 |

FOREIGN PATENT DOCUMENTS

| | | | |
|---|---|---|---|
| JP | 59221409 | A * | 12/1984 |
| JP | 59226209 | A * | 12/1984 |
| JP | 59226209 | A2 | 12/1984 |

* cited by examiner

ENERGY RECOVERY SYSTEM

TECHNICAL FIELD

The present disclosure is directed to an energy recovery system, and more particularly, to an energy recovery system for use in an internal combustion engine with an exhaust treatment device.

BACKGROUND

Conventional internal combustion engines utilize approximately 30% of the total energy available from any given amount of fuel. The remaining unused energy is consumed by chemical reactions, frictional losses, and engine exhaust. Such a low fuel economy may be improved by recovering at least a portion of the unused energy.

One attempt to improve fuel economy by recovering at least a portion of the unused energy can be found in U.S. Pat. No. 5,176,000 (the '000 patent) issued to Dauksis on Jan. 5, 1993. The '000 patent discloses a system for recovering energy lost to engine exhaust. The system includes a cooling system in fluid communication with a plurality of engine cylinders, an engine exhaust manifold, and a turbine. A fluid in a liquid state initially absorbs heat from the combustion process occurring in the engine cylinders raising the temperature of the fluid and maintaining the temperature of the engine within a desired range. After absorbing heat from the engine cylinders, the fluid flows around the engine exhaust manifold. There, the fluid absorbs heat from the exhaust gas further raising the temperature of the fluid. Upon absorbing heat from the engine exhaust manifold, the fluid temperature becomes high enough to turn the fluid into a gas. The gas is then directed to and drives a turbine, which is connected to a generator. As the turbine rotates, it drives the generator producing electric power. The generated electric power may be stored or used to power an electric motor.

Although the system in the '000 patent may improve fuel economy by recovering the portion of energy lost to engine exhaust, the fuel economy improvement may be limited. In particular, the '000 system focuses only on recovering energy lost to engine exhaust and ignores other potential sources of unused energy. For example, some of the available energy is lost through chemical reactions such as those found in catalytic exhaust treatment devices. By focusing only on one potential source of unused energy, fuel economy improvement may be limited and potential operational cost savings may not be fully realized.

The disclosed system is directed to overcoming one or more of the problems set forth above.

SUMMARY OF THE INVENTION

In one aspect, the present disclosure is directed toward an energy recovery system including a fluid configured to absorb and convey thermal energy. The system also includes an exhaust treatment device cooling system configured to transmit thermal energy from an exhaust treatment device to the fluid. In addition, the system includes a turbine that is driven by the fluid and configured to convert at least a portion of the thermal energy to mechanical energy. The system further includes a generator that is powered by the turbine and configured to convert at least a portion of the mechanical energy to electrical energy.

Consistent with another aspect of the disclosure, a method is provided for recovering energy. The method includes receiving thermal energy from an exhaust treatment device, converting at least a portion of the thermal energy to mechanical energy, and converting at least a portion of the mechanical energy to electrical energy.

DETAILED DESCRIPTION

Figure 1:
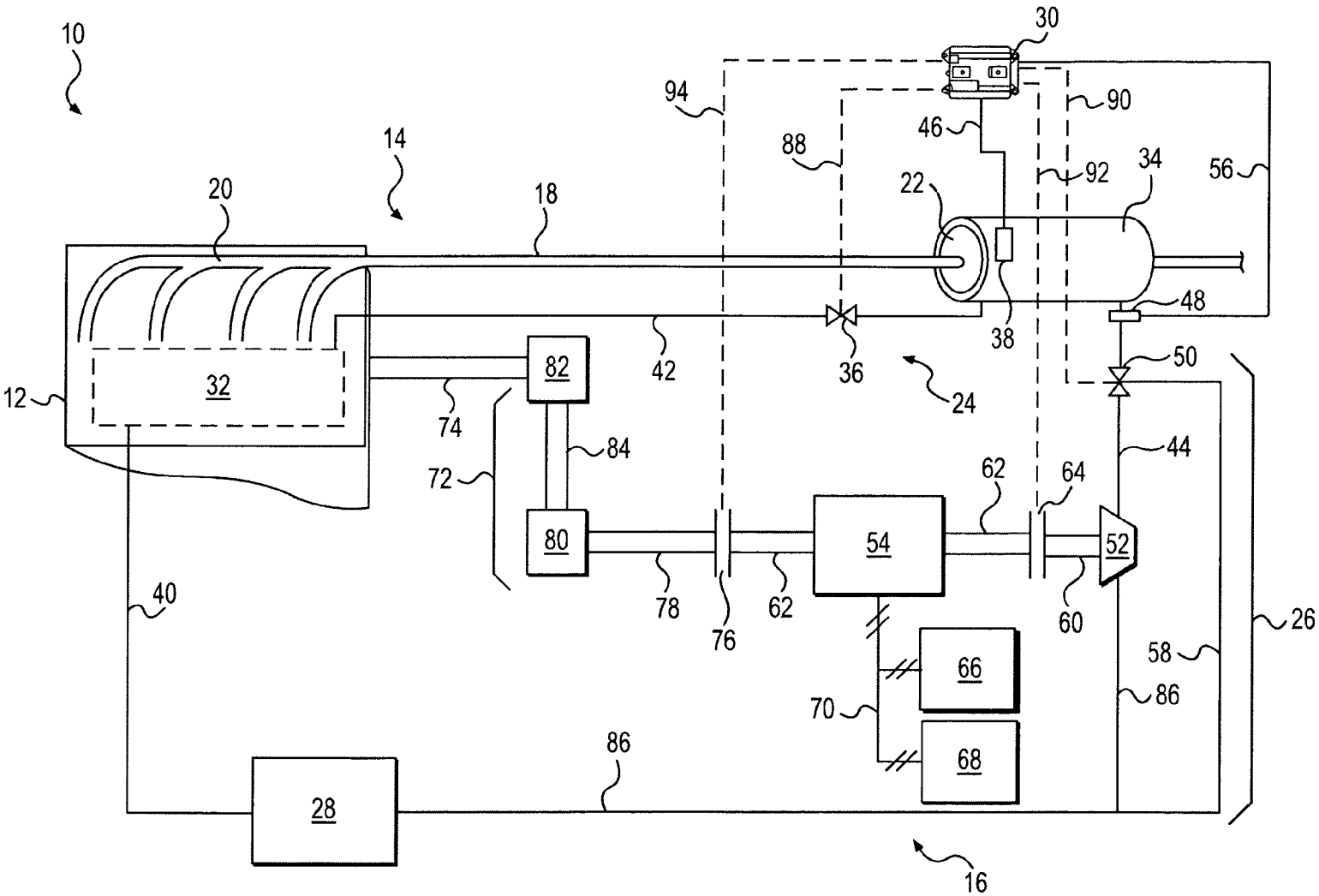
FIG. 1 is a diagrammatic illustration of an exemplary disclosed power system.

FIG. 1 illustrates an exemplary power system 10 having multiple subsystems that cooperate to produce mechanical or electrical power output. Power system 10 may include a power source 12, an exhaust treatment system 14, and an energy recovery system 16. Other subsystems included within power system 10 may be, for example, a fuel system, an air induction system, a lubrication system, a cooling system, or any other appropriate system (not shown). For the purposes of this disclosure, power source 12 is depicted and described as a four-stroke diesel engine. One skilled in the art will recognize, however, that power source 12 may be any source of power that generates an exhaust stream and may include, for example, a gasoline-powered engine, a gaseous fuel-powered engine, or any other type of internal combustion engine known in the art.

Exhaust system 14 may remove or reduce the amount of pollutants in the exhaust produced by power source 12 and release the treated exhaust into the atmosphere. Exhaust system 14 may include an exhaust passage 18 which may be in fluid communication with an exhaust manifold 20 of power source 12. Exhaust system 14 may also include exhaust treatment devices fluidly connected along exhaust passage 18 such as a catalytic device 22. It is contemplated that exhaust system 14 may include additional components such as, for example, particulate traps, attenuation devices, and other means for directing exhaust flow out of power source 12 that are known in the art.

Catalytic device 22 may include components that function to treat exhaust as it flows from exhaust manifold 20. Specifically, exhaust emissions may flow from exhaust manifold 20 through a catalyst medium (not shown) that is retained within a housing of catalytic device 22. It is contemplated that one or more catalyst mediums may alternatively be arranged to receive the gaseous emissions in series or parallel relation. The number of catalyst mediums within catalytic device 22 may be variable and depend on the back pressure, filtration, and size requirements of a particular application.

Energy recovery system 16 may extract energy generated from the combustion of a fuel in power source 12 that may otherwise be unused by power system 10. Energy recovery system 16 may include a coolant fluid, which may flow through and/or around various heat-generating devices of power system 10 that generate thermal energy. While flowing through and/or around the heat-generating devices, the coolant fluid may absorb the generated thermal energy from the heat-producing devices and may convey the thermal energy to a device configured to convert such energy into a useful form such as mechanical or electrical energy. It should be understood that the coolant fluid may be any type of fluid, such as, for example, water, glycol, a water/glycol mixture, or any other liquid capable of absorbing and conveying thermal energy. Energy recovery system 16 may also include a cooling portion 24, an energy conversion portion 26, a condenser 28, and a controller 30 for regulating the flow of fluid through energy recovery system 16.

Cooling portion 24 may absorb thermal energy from power source 12 and may include a power source cooling device 32, a catalytic device cooling system 34, a flow control valve 36, and a temperature sensor 38. It is contemplated that cooling portion 24 may absorb thermal energy from other heat generating devices of power system 10, if desired.

Power source cooling device 32 may be situated within the structure of power source 12 to prevent a temperature of power source 12 from rising above a predetermined threshold. Power source cooling device 32 may be, for example, a coolant jacket, or any other device capable of utilizing coolant fluid to maintain the temperature of power source 12. In addition, power source cooling device 32 may be a part of a power source cooling system (not shown) for maintaining the temperature of power source 12. It is contemplated that the power source cooling system may operate independently of or be coordinated with energy recovery system 16. During operation, the coolant fluid may enter power source cooling device 32 in a liquid state through a fluid passageway 40, absorb heat generated within power source 12, and exit power source cooling device 32 through a fluid passageway 42.

Catalytic device cooling system 34 may be fluidly connected to power source cooling device 32 via fluid passageway 42. In addition, catalytic device cooling system 34 may include, for example, a coolant jacket surrounding the housing of catalytic device 22 or any other device capable of utilizing coolant fluid to maintain the temperature of catalytic device 22. During operation, coolant fluid may enter catalytic device cooling system 34 via fluid passageway 42 and exit catalytic device cooling system 34 through a fluid passageway 44. Furthermore, while flowing through catalytic device cooling system 34, the coolant fluid may absorb thermal energy contained within exhaust gas flowing through catalytic device 22 as well as thermal energy generated by exothermic chemical reactions occurring within catalytic device 22.

Flow control valve 36 may be situated within fluid passageway 42 for regulating the flow of the coolant fluid through cooling portion 24. Flow control valve 36 may be any type of proportional valve such as, for example, a butterfly valve, a diaphragm valve, a gate valve, a ball valve, a globe valve, or any other valve known in the art. In addition, flow control valve 36 may be solenoid-actuated, hydraulically-actuated, pneumatically-actuated or actuated in any other manner to selectively restrict the flow of coolant fluid through fluid passageway 42.

Temperature sensor 38 may include any type of temperature sensing device known in the art. For example, temperature sensor 38 may include a surface-type temperature sensing device that measures a surface temperature of catalytic device 22. Alternately, temperature sensor 38 may include a temperature sensing device that measures the temperature of an interior surface of catalytic device cooling system 34. Upon measuring the temperature of catalytic device 22, temperature sensor 38 may generate a temperature signal and send this signal to controller 30 via a communication line 46, as is known in the art. This temperature signal may be sent continuously, on a periodic basis, or only when prompted to do so by controller 30, if desired.

Energy conversion portion 26 may convert at least a portion of the thermal energy absorbed by the coolant fluid into mechanical and/or electrical energy. In addition, energy conversion portion 26 may include a sensor 48, a bypass valve 50, a turbine 52, and a generator 54. It is contemplated that energy conversion portion 26 may omit generator 54 and convert the thermal energy to only mechanical energy, if desired.

Sensor 48 may include any type of thermal energy sensing device known in the art. For example, sensor 48 may include a surface-type temperature sensing device that measures a wall temperature of fluid passageway 44. Alternately, sensor 48 may include temperature sensing devices that directly measure the temperature of the coolant fluid within fluid passageway 44. Upon measuring the thermal energy of the coolant fluid, sensor 48 may generate a thermal energy signal and send this signal to controller 30 via communication line 56, as is known in the art. This thermal energy signal may be sent continuously, on a periodic basis, or only when prompted to do so by controller 30, if desired.

Bypass valve 50 may be situated within fluid passageway 44 and may selectively direct the coolant fluid through bypass 58. For example, if the coolant fluid is in a liquid state or does not contain a desired thermal energy upon exiting catalytic device cooling system 34, bypass valve 50 may be actuated to direct the coolant fluid away from turbine 52 via bypass 58. Bypass valve 50 may be any type of three way valve capable of directing the coolant fluid through bypass 58. In addition, bypass valve 50 may be solenoid-actuated, hydraulically-actuated, pneumatically-actuated or actuated in any other manner to selectively direct the flow of coolant fluid through bypass 58.

Turbine 52 may drive generator 54 and be connected to generator 54 by way of shafts 60 and 62 and clutch 64. Clutch 64 may selectively engage turbine 52 with generator 54. In particular, when the coolant fluid is diverted away from turbine 52 through bypass 58, clutch 64 may be actuated to disengage turbine 52 from generator 54. Conversely, when the coolant fluid is flowing through turbine 52, clutch 64 may be actuated to engage turbine 52 with generator 54. In situations where coolant fluid is directed to turbine 52, the coolant fluid may enter turbine 52 and expand against blades (not shown) of turbine 52. By expanding against the blades, the coolant fluid may cause turbine 52 to rotate and cause the connected generator 54 to generate electric power. It is contemplated that energy conversion portion 26 may omit clutch 64 and that turbine 52 may be connected to generator 54 by a common shaft, if desired.

Generator 54 may generate electric energy for powering one or more electric motors 66 or power storage devices 68. Such electric power may be transmitted via electric power lines 70. It should be understood that generator 54 may be any known AC or DC generator such as, permanent magnet, induction, switched-reluctance, or a hybrid combination of the above, and may also be sealed, brushless, and/or liquid cooled, for example, to provide a more durable design. In an exemplary embodiment, It is contemplated that generator 54 may produce a direct current (DC) output or an alternating current (AC) output. It is also contemplated that AC or DC outputs may be converted with the use of a power converter (not shown) to produce a variety of current and/or voltage outputs for use by various components of power system 10.

Generator 54 may also operate as a motor and provide mechanical energy to power source 12 via a transmission system 72. Transmission system 72 may transmit mechanical energy from generator 54 by conveying the rotational motion of shaft 62 to a crankshaft 74 of power source 12. Transmission system 72 may include a clutch 76, a shaft 78, pulleys 80 and 82, and a belt 84. When it is desired to transmit mechanical energy to power source 12, clutch 76 may be actuated to engage shaft 62 with shaft 78. Once engaged, the rotational motion of shaft 62 may be transmitted to pulley 80 via shaft 78. Furthermore, the rotational motion of pulley 80 may be transmitted to pulley 82 and ultimately crankshaft 74 via belt 84. It is contemplated that pulleys 80 and 82 may be replaced with gears or any other device capable of conveying a rotational motion. It is further contemplated that belt 84 may be replaced with a chain or any other device capable of transmitting rotational motion from one pulley or gear to the other.

Condenser 28 may be fluidly connected to turbine 52 and fluid passageway 58 via a fluid passageway 86 and may remove any thermal energy remaining in the coolant fluid. Condenser 28 may be any kind of device capable of removing thermal energy from the coolant fluid such as, for example, a radiator. The coolant fluid may exit condenser 28 in a liquid state and be directed toward power source 12 via fluid passageway 40. It is contemplated that a fluid pump (not shown) may be disposed within fluid passageway 40 between condenser 28 and power source 12 to assist the flow of coolant fluid through energy recovery system 16, if desired.

Controller 30 may include one or more microprocessors, a memory, a data storage device, a communication hub, and/or other components known in the art and may be associated only with energy recovery system 16. However, it is contemplated that controller 30 may be integrated within a general control system capable of controlling additional functions of power system 10, e.g., selective control of power source 12, and/or additional systems operatively associated with power system 10, e.g., selective control of a transmission system (not shown).

Controller 30 may receive signals from temperature sensor 38 and analyze the data to determine whether the temperature of catalytic device 22 is within a desired temperature range by comparing the data to threshold temperatures stored in or accessible by controller 30. Upon receiving input signal from temperature sensor 38, controller 30 may perform a plurality of operations, e.g., algorithms, equations, subroutines, reference look-up maps or tables to establish an output to influence the operation of flow control valve 36 via communication line 88. Alternatively, it is contemplated that controller 30 may receive signals from various sensors (not shown) located throughout energy recovery system 16 and/or power system 10 instead of temperature sensor 38. Such sensors may sense parameters that may be used to calculate the temperatures of power source 12 and catalytic device 22.

Controller 30 may also receive a signal from sensor 48 and analyze the data to determine whether the thermal energy of the coolant fluid is at or above a desired level by comparing the data to threshold thermal energy levels stored in or accessible by controller 30. Upon receiving an input signal from sensor 48, controller 30 may perform a plurality of operations, e.g., algorithms, equations, subroutines, reference look-up maps or tables to establish an output to influence the operation of bypass valve 50 via communication line 90. Controller 30 may also establish an output to influence clutch 64 based on the input signal from sensor 48 via a communication line 92. Alternatively, it is contemplated that controller 30 may receive signals from various sensors (not shown) located throughout energy recovery system 16 and/or power system 10 instead of sensor 48. Such sensors may sense parameters that may be used to calculate the thermal energy of the coolant fluid exiting catalytic device cooling system 34.

It should be understood that controller 30 may selectively actuate clutch 76 via engagement and disengagement signals sent through communication line 94 to operatively engage or disengage generator 54 from power source 12. Such engagement and disengagement signals may be based on input from an operator or signals received from temperature sensor 46 and sensor 48. It is contemplated that operation of clutch 76 may also depend on other conditions of power system 10 such as, for example, power source speed, the remaining capacity of power storage device 68, the operating condition of electric motor 66, or any other condition of power system 10 that may influence the decision whether engage or disengage generator 54 from power source 12.

Figure 2:
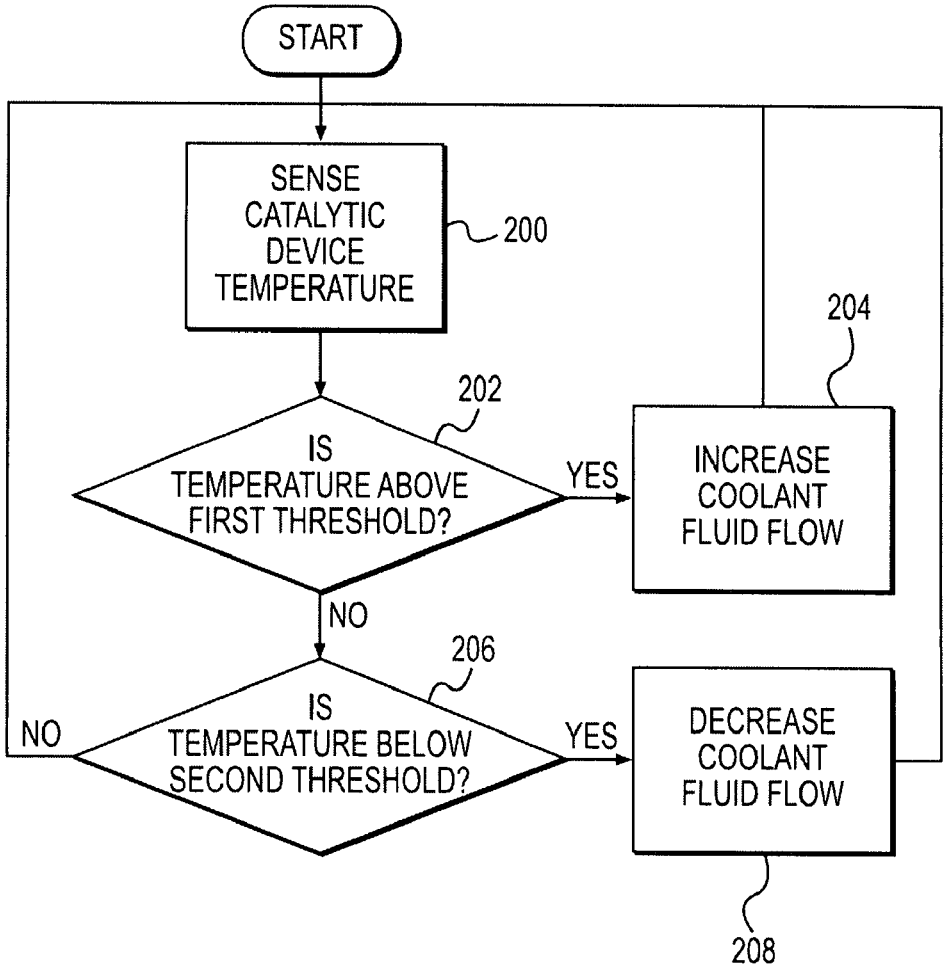
FIG. 2 is a flow chart depicting an exemplary method of operating a cooling portion of an exemplary energy recovery system of the power system of FIG. 1.
Figure 3:
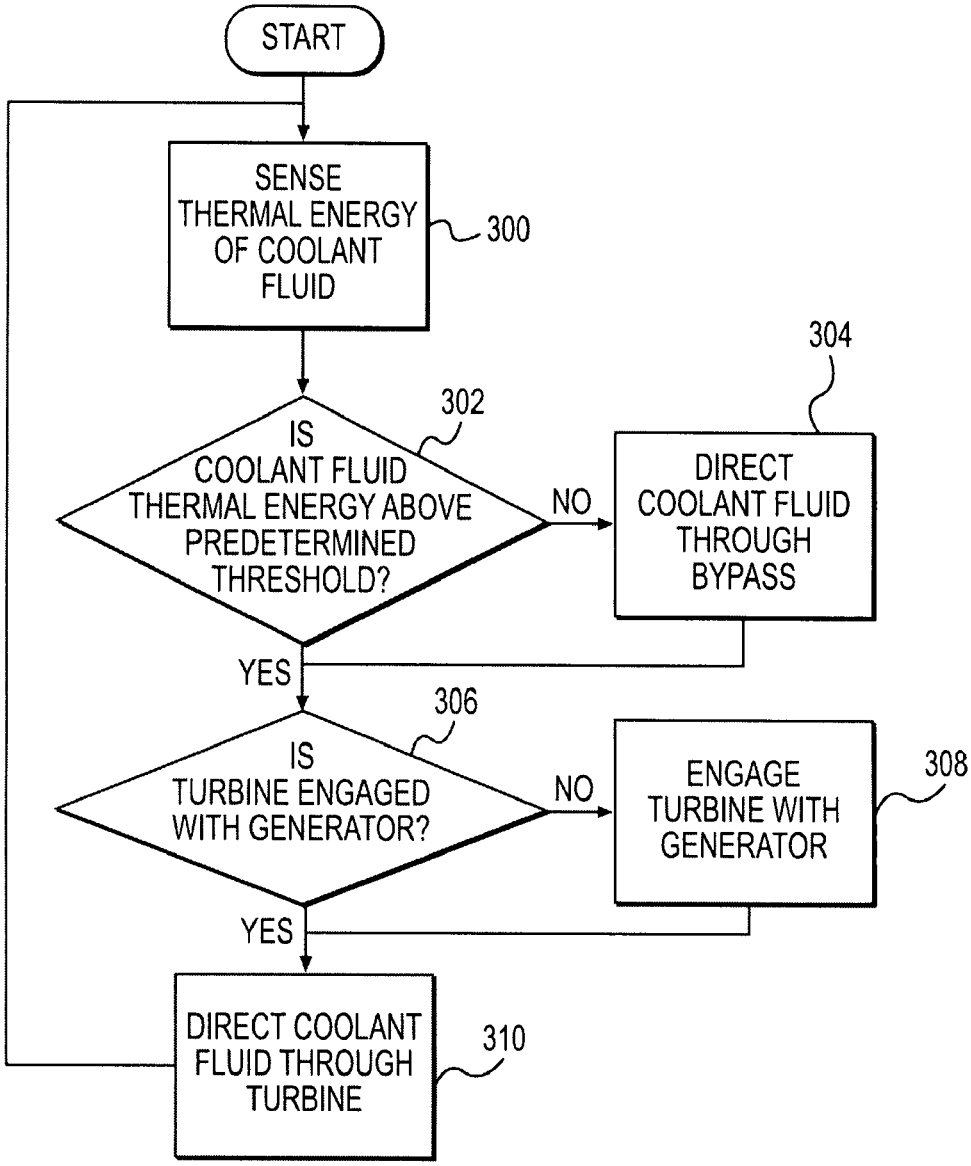
FIG. 3 is a flow chart depicting an exemplary method of operating an energy conversion portion of the energy recovery system of the power system of FIG. 1.

FIGS. 2 and 3, which are discussed in the following section, illustrate the operation of energy recovery system 16 utilizing embodiments of the disclosed system. Specifically, FIG. 2 illustrates an exemplary method for maintaining catalytic device 22 within a desired temperature range and recovering unused energy produced by the combustion of fuel in power source 12. FIG. 3 illustrates an exemplary method for converting the recovered energy into a more useful form.

INDUSTRIAL APPLICABILITY

The disclosed energy recovery system may improve fuel economy while maintaining an emission treatment device within a desired temperature range. In particular, the disclosed energy recovery system may convert at least a portion of unused thermal energy generated by exothermal chemical reactions in the emission treatment device and unused thermal energy generated by the combustion of fuel into usable mechanical and/or electrical energy. The operation of energy recovery system 16 will now be explained.

FIG. 2 illustrates a flow diagram depicting an exemplary method for regulating the temperature of catalytic device 22 while recovering unused thermal energy from exhaust system 14. The method may begin when controller 30 receives a temperature signal from temperature sensor 38 indicative of a temperature of catalytic device 22 (step 200). Controller 30 may compare the sensed catalytic device temperature to tables, graphs, and/or equations stored in its memory to determine whether the sensed temperature is above a first predetermined temperature (step 202). It is contemplated that the first predetermined threshold may be a temperature likely to damage catalytic device 22 or any other element of power system 10. For example, if catalytic device 22 is a three-way catalyst, the first predetermined threshold may be 950 degrees Celsius because temperatures above 950 degrees Celsius may cause damage to the three-way catalyst.

If controller 30 determines that the sensed catalytic device temperature is above the first predetermined threshold (step 202: Yes), flow control valve 36 may be set to a position increasing the flow of coolant fluid through fluid passageway 42 (step 204). After the flow of coolant fluid through fluid passageway 42 has been increased, step 200 may be repeated (i.e. controller 30 may receive a temperature signal from temperature sensor 38 indicative of a temperature of catalytic device 22).

However, if controller 30 determines that the sensed catalytic device temperature is below the first predetermined threshold (step 202: No), controller 30 may determine whether the catalytic device temperature is below a second predetermined threshold (step 206). It is contemplated that the second predetermined threshold may be an optimal operating temperature of catalytic device 22. For example, if catalytic device 22 is a three-way catalyst, the second predetermined threshold may be 200 degrees Celsius because temperatures above 200 degrees Celsius may provide optimal conditions for the operation of the three-way catalyst. If controller 30 determines that the sensed catalytic device temperature is below the second predetermined threshold (step 206: Yes), flow control valve 36 may be set to a position decreasing the flow of coolant fluid through fluid passageway 42 (step 208). After the flow of coolant fluid through fluid passageway 42 has been decreased, step 200 may be repeated (i.e. controller 30 may receive a temperature signal from temperature sensor 38 indicative of a temperature of catalytic device 22). However, if controller 30 determines that the sensed catalytic device temperature is above the second predetermined threshold (step 206: No), step 200 may be repeated (i.e. controller 30 may receive a temperature signal from temperature sensor 38 indicative of a temperature of catalytic device 22).

FIG. 3 illustrates a flow diagram depicting an exemplary method for converting the recovered thermal energy into more useful electric or mechanical energy. The method may begin when controller 30 receives a thermal energy signal from sensor 48 indicative of thermal energy contained within the coolant fluid exiting catalytic device cooling system 34 (step 300). Controller 30 may compare the sensed thermal energy to tables, graphs, and/or equations stored in its memory to determine whether the sensed thermal energy is above a predetermined thermal energy level (step 302). It is contemplated that the predetermined threshold may be a minimal thermal energy level above which the coolant fluid may be able to drive turbine 52. Alternately, the predetermined threshold may be a thermal energy level below which the coolant fluid may remain in a liquid state.

If controller 30 determines that the sensed coolant fluid thermal energy is below the predetermined threshold (step 302: No), bypass valve 50 may be set to a position directing the coolant fluid through bypass 58 (step 304). After bypass valve 50 is set to the position directing the coolant fluid through bypass 58, step 300 may be repeated (i.e. controller 30 may receive a thermal energy signal from sensor 48 indicative of thermal energy contained within the coolant fluid exiting catalytic device cooling system). However, if controller 30 determines that the sensed coolant fluid thermal energy is above the predetermined threshold (step 302: Yes), Controller 30 may actuate clutch 64 so that turbine 52 and generator 54 are engaged (step 306). After turbine 52 and generator 54 are engaged, bypass valve 50 may be set to a position directing the coolant fluid through turbine 52 (step 308). After bypass valve 50 is set to the position directing the coolant fluid through turbine 52, step 300 may be repeated (i.e. controller 30 may receive a thermal energy signal from sensor 48 indicative of thermal energy contained within the coolant fluid exiting catalytic device cooling system 36).

As the heated coolant fluid flows through turbine 52, the coolant fluid may cause shaft 60 to rotate transforming the thermal energy contained within the coolant fluid into mechanical energy. Furthermore, when clutch 64 is actuated to engage turbine 52 with generator 54, the rotational motion of shaft 60 may cause shaft 62 to rotate transferring the mechanical energy to generator 54. After being transferred to generator 54, the recovered energy may remain in mechanical form, be partially converted to electrical form, or be fully converted to electrical form.

In some circumstances, it may be desired to use the recovered energy only to assist power source 12 and fully maintain the recovered energy in mechanical form. When fully maintaining the recovered energy in mechanical form, controller 30 may actuate clutch 76 via communication line 94 to engage shaft 62 with shaft 78. Once shaft 62 is engaged with shaft 78, the rotational motion may be transferred to shaft 78 and ultimately crankshaft 74 of power source 12 via transmission system 72. In addition, it may be desired to isolate generator 54 from electric motor 66 and power storage device 68 so that none of the mechanical energy is converted to electrical energy. This may be done by actuating a switch (not shown) or any other device capable of isolating power line 70 from generator 54.

It is contemplated that generator 54 may assist power source 12 even when the coolant fluid is diverted away from turbine 52. Clutch 64 may be actuated to disengage generator 54 from turbine 52. In addition, electric energy stored within power storage device 68 may be directed through generator 54 causing generator 54 to operate as a motor and rotate shaft 62. Once shaft 62 begins rotating, transmission system 72 may operate in the manner disclosed above to assist power source 12.

In other circumstances, it may be desired to use the recovered energy to assist power source 12, assist electric motor 66 and/or charge power storage device 68. In such circumstances, the recovered energy may be partially maintained in mechanical form and partially converted to electrical form. Controller 30 may actuate clutch 76 via communication line 94 to engage shaft 62 with shaft 78, and generator 54 may remain in communication with electric motor 66 and power storage device 68.

It may also be desired to fully convert the recovered energy to electrical energy to power electric motor 66 and/or charge power storage device 68. In such circumstances controller 30 may actuate clutch 76 via communication line 94 to disengage shaft 62 from shaft 78 isolating generator 54 from power source 12. In addition, generator 54 may remain in communication with electric motor 66 and/or power storage device 68.

Because the disclosed system may recover energy from multiple sources such as the thermal energy in the engine exhaust as well as thermal energy generated by exothermal chemical reactions in the emissions treatment device, the system may be able to recover a greater percentage of the unused energy generated from the combustion of fuel in the combustion chambers of the engine. By recovering a greater percentage of the unused energy, the engine efficiency and fuel economy may be further improved. Furthermore, operational costs may be further reduced.

It will be apparent to those skilled in the art that various modifications and variations can be made in the disclosed system without departing from the scope of the disclosure. Other embodiments will be apparent to those skilled in the art from consideration of the specification disclosed herein. It is intended that the specification and examples be considered as exemplary only, with a true scope being indicated by the following claims and their equivalents.

What is claimed is:

1. An energy recovery system, comprising:

a fluid configured to absorb and convey thermal energy;

an exhaust treatment device;

an exhaust treatment device cooling system configured to transmit thermal energy from the exhaust treatment device to the fluid by directing the fluid about an exterior surface of the exhaust treatment device;

a turbine that is driven by the fluid and configured to convert at least a portion of the thermal energy to mechanical energy;

a generator that is powered by the turbine and configured to convert at least a portion of the mechanical energy to electrical energy;

at least one sensor configured to sense a parameter indicative of a temperature of the exhaust treatment device; and a controller configured to adjust a flow of the fluid in response to the sensed parameter indicative of the temperature of the exhaust treatment device by comparing the sensed parameter to a first threshold and increasing the flow of the fluid if the sensed parameter exceeds the first threshold, and comparing the sensed parameter to a second threshold and decreasing the flow of the fluid if the sensed parameter is less than the second threshold, wherein the first threshold is a temperature above which the exhaust treatment device suffers damage, and the second threshold is a temperature below which exhaust treatment device performance suffers.

2. The energy recovery system of claim 1, further including at least one sensor configured to sense a level of thermal energy contained within the fluid.

3. The energy recovery system of claim 2, wherein the controller is configured to direct the fluid through a bypass of the turbine when the thermal energy of the fluid is below a predetermined threshold.

4. The energy recovery system of claim 1, wherein the generator is operationally coupled to at least one power storage device and/or at least one motor.

5. The energy recovery system of claim 4, wherein the generator is configured to operate as a motor powered by energy stored in the at least one power storage device.

6. The energy recovery system of claim 5, wherein the turbine is selectively coupled to the generator and the controller is configured to decouple the turbine from the generator when the thermal energy of the fluid is below a predetermined threshold and the generator operates as a motor.

7. A method of recovering energy, comprising:

directing a fluid about an exterior surface of an exhaust emission treatment device;

removing thermal energy from the exhaust emissions treatment device with the fluid;

converting at least a portion of the thermal energy to mechanical energy;

selectively converting at least a portion of the mechanical energy to electrical energy;

sensing a first parameter indicative of a temperature of the exhaust treatment device; and controlling the directing of fluid to the exhaust treatment device in response to the first sensed parameter by comparing the first sensed parameter to a first threshold and increasing the flow of the fluid if the first sensed parameter exceeds the first threshold, and comparing the first sensed parameter to a second threshold and decreasing the flow of the fluid if the first sensed parameter is less than the second threshold, wherein the first threshold is a temperature above which the exhaust treatment device suffers damage, and the second threshold is a temperature below which exhaust treatment device performance suffers.

8. The method of claim 7, further including receiving thermal energy from a power source.

9. The method of claim 8, further including selectively using at least a portion of the mechanical energy to provide power to the power source.

10. The method of claim 9, further including selectively storing at least a portion of the electrical energy and/or powering an electric motor.

11. The method of claim 7, further including sensing a second parameter indicative of a temperature of the fluid, and controlling the directing of fluid away from the exhaust treatment device in response to the second sensed parameter.

12. A power system, comprising: a power source configured to generate a power output;

an exhaust system configured to treat exhaust generated by the power source, the exhaust system including an exhaust treatment device; and an energy recovery system including:

a fluid configured to absorb and convey thermal energy;

an exhaust treatment device cooling system configured to transmit thermal energy from the exhaust treatment device to the fluid;

a turbine that is driven by the fluid and configured to convert at least a portion of the thermal energy to mechanical energy;

a generator that is powered by the turbine and configured to convert at least a portion of the mechanical energy to electrical energy;

a first sensor situated to sense a first parameter indicative of a temperature of the exhaust treatment device;

a second sensor situated to sense a second parameter indicative of a thermal energy of the fluid; and a controller configured to adjust a flow of the fluid into the exhaust treatment device cooling system in response to the first sensed parameter, and adjust a flow of the fluid away from the exhaust treatment device cooling system in response to the second sensed parameter, wherein the controller is configured to adjust a flow of the fluid into the exhaust treatment device cooling system by comparing the first sensed parameter to a first threshold, above which the exhaust treatment device suffers damage, and increasing the flow of the fluid if the first sensed parameter exceeds the first threshold, and comparing the first sensed parameter to a second threshold, below which exhaust treatment device performance suffers, and decreasing the flow of the fluid if the first sensed parameter is less than the second threshold.

13. The power system of claim 12, wherein the controller is configured to direct the fluid through a bypass of the turbine when the thermal energy of the fluid is below a predetermined threshold.

14. The power system of claim 13, further including a transmission unit selectively coupled to the generator and operationally connected to the power source, wherein the transmission unit is configured to convey mechanical energy to the power source.

15. The power system of claim 14, wherein the controller is configured to disengage the generator from the transmission unit when the generator converts mechanical energy to electrical energy.

16. The power system of claim 14, wherein the turbine is selectively coupled to the generator and the controller is configured to decouple the turbine from the generator when the thermal energy of the fluid is below the predetermined threshold and the generator operates as a motor.

17. The power system of claim 12 further including a power source cooling device configured to transmit thermal energy from the power source to the fluid, wherein the power source cooling device is situated within the structure of the power source.

* * * * *